US005196155A

United States Patent [19]

Askin et al.

[11] Patent Number: 5,196,155

[45] Date of Patent: Mar. 23, 1993

[54] REMOVABLE FILTER SIEVE FOR COMBUSTION PIPING

[75] Inventors: Kerim Askin; John D. Butler, both of Carroll County, Ga.

[73] Assignee: Southwire Company, Carrollton, Ga.

[21] Appl. No.: 786,635

[22] Filed: Nov. 1, 1991

[51] Int. Cl.[5] ..... C21B 7/24

[52] U.S. Cl. ..... 266/99; 266/270

[58] Field of Search ..... 431/346; 48/192; 137/547; 210/232, 437; 266/89, 99, 218, 265, 270, 900, 901

[56] References Cited

U.S. PATENT DOCUMENTS 1,778,876 10/1930 Weaver .
1,868,708 7/1932 Hunt ..... 48/192
2,277,294 3/1942 Brooks .
2,420,599 5/1947 Jurs .
3,094,978 6/1963 McCray et al. .
3,243,272 3/1966 Schmitz .
4,301,997 11/1981 Berry et al. .

*Primary Examiner*—Melvyn J. Andrews
*Attorney, Agent, or Firm*—James W. Wallis, Jr.; Stanley L. Tate

[57] ABSTRACT

A combustion piping system for a metal melting furnace is disclosed in which a sieve is used upstream of a flashback arrester to collect particulate matter carried in the fuel flow to the furnace so as to minimize maintenance of the flashback arrester. The sieve is mounted in a sieve holder that is arranged to be rapidly removed from and replaced in the piping system during furnace operation so as to minimize the pressure drop in the fuel flow to the furnace.

20 Claims, 1 Drawing Sheet

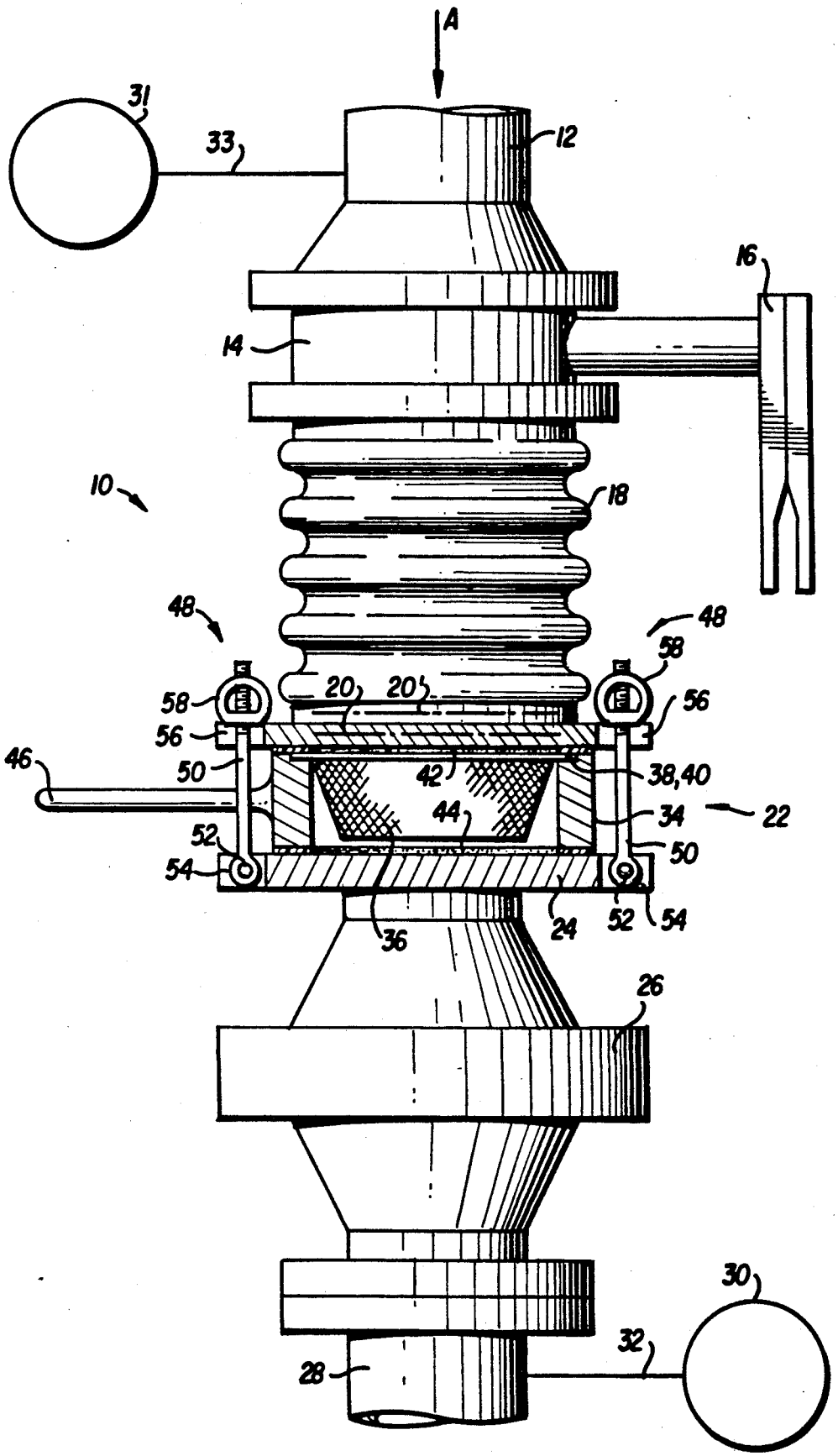
A
31
33
12
16
14
10
18
48
48
58
58
20
20'
56
56
46
50
42
38,40
44
34
22
52
50
54
24
52
54
36
26
30
32
28

REMOVABLE FILTER SIEVE FOR COMBUSTION PIPING

FIELD OF THE INVENTION

The present invention relates to combustion piping systems for use with metal melting furnaces and more particularly to a filtering apparatus used in the combustion piping system of a metal melting furnace fired with a premixed gaseous fuel mixture.

DESCRIPTION OF THE PRIOR ART

In the known combustion piping systems for supplying a premixed gaseous fuel to the burners of a metal melting furnace, one or more flashback arresters are used to minimize damage that could result from a burner backfire. The combustion piping systems for such furnaces are subject to contamination with rust, dirt, pipe scale and other solid particulate matter which tends to collect at the flashback arrester and create a substantial pressure drop across the arrester resulting in a reduction in flow of the premixed gaseous fuel to the furnace.

As a consequence of this contamination, flashback arresters must be periodically removed from the combustion piping for inspection and, when necessary, the arrester inserts must be cleaned or replaced. Because of the particular requirements for the operation and function of flashback arresters, the design of such arresters makes cleaning them rather difficult and time consuming. One prior art proposal to alleviate this problem is disclosed in U.S. Pat. No. 2,420,599 in which a flame arrester tube bank or absorber unit is removably retained between the usual bell-shaped body sections of the arrester housing so that it may be removed laterally from the arrester and replaced without disturbing the other connections of the combustion piping system. A similar approach is disclosed in U.S. Pat. No. 2,277,294.

While these prior art arrangements make possible the quick replacement of the absorber unit of the flame or flashback arrester, the cleaning of the absorber unit remains a difficult and time consuming task because all particulate contaminants in the combustion piping are still collected at the absorber unit of the flame arrester. It would be desirable, therefore, to minimize the extent to which the flame arrester or flashback arrester is required to function as a filtering means for particulate contaminants in the combustion piping system.

U.S. Pat. No. 3,243,272 discloses the use of a flashback arrester in an autogenous welding installation. A screen or sieve is used upstream of the flashback arrester to prevent the entry of foreign bodies into the flame arrester housing. Replacement of the sieve requires the unthreading of a hose receiving nipple so that the sieve can be axially removed from a threaded bore which forms part of the flashback arrester housing.

U.S. Pat. No. 4,301,997, assigned to the assignee of the present invention, discloses a vertical shaft furnace for continuously melting copper which is fired by a premixed gaseous fuel. The fuel is supplied to the melting furnace by a plurality of combustion piping manifolds which direct the premixed fuel to the furnace burner assemblies via individual burner piping. Each individual burner piping includes a shutoff valve, a flashback arrester and a flexible expansion coupling.

SUMMARY OF THE INVENTION

The present invention is directed to a sieve for use in conjunction with a flashback arrester in the fixed combustion piping installation of a metal melting furnace, especially a large shaft furnace for melting nonferrous metals, such as copper and aluminum. In these types of installations, a gaseous fuel, such as natural gas and air, is premixed remotely of the furnace burners and is supplied to the burners via a fixed combustion piping system including fixed manifolds from which an individual fixed piping line supplies the combustible premixed gaseous fuel to a furnace burner assembly. Each individual piping line is conventionally provided with a shutoff valve and a flashback arrester mounted upstream of the fuel inlet to the burner assembly. U.S. Pat. No. 4,301,997 mentioned above describes such an arrangement and the disclosure thereof is incorporated herein by reference.

According to the invention, between the flashback arrester and the shutoff valve there is positioned a sieve holder that is mounted for quick removal in a direction transversely with respect to the longitudinal axis of the piping line without requiring dismantling of the piping line or shutdown of the furnace. The sieve holder comprises a tubular housing, preferably cylindrical, with annular end faces adapted to receive sealing gaskets which may be glued, riveted or otherwise secured to the annular end faces.

The sieve holder houses a filter or sieve made of a mesh of metal wire or other suitable material and which may be disposable or reusable. In the preferred embodiment, the sieve has a truncated conical shape, but may have other shapes to provide a greater surface area for collection of foreign matter, e.g., a corrugated cylindrical shape. The sieve holder is advantageously positioned between confronting flanges of the piping system, i.e., between the upstream flange of the flashback arrester and the downstream flange of an expansion joint or coupling comprising a corrugated tube which has a certain degree of axial resilience.

The sieve holder preferably has a handle affixed to the outer circumferential wall thereof for handling the sieve holder during removal and replacement thereof. In its unstressed condition, the axially resilient expansion joint is disposed so that its downstream flange is spaced from the upstream flange of the flashback arrester a distance greater than the axial length of the tubular housing of the sieve holder.

A quick release mechanism is used to secure the sieve holder between the confronting flanges and, although other equivalent mechanisms could be employed, in the preferred embodiment described herein, such mechanism comprises a plurality of threaded toggle bolts that are pivotally connected to one of the confronting flanges and engage in slots in the other confronting flange. A wing nut or threaded dog is used to urge the flanges toward one another and effect a gasketed seal between each flange and the respective annular end face of the sieve holder. When a seal is effected, the corrugated expansion joint is in a slightly axially tensioned condition.

During operation of the metal melting furnace, the sieve functions to collect relatively large particulate matter before it reaches the flashback arrester. The particulate matter, which is usually composed of rust particles, pipe scale, and the like, is carried along in the flowing stream of premixed gaseous fuel. When the particulate matter begins to occlude flow of the premixed gaseous fuel through the sieve, a pressure drop will occur that can be sensed by measuring the pressure with a pressure sensor located downstream of the flashback arrester so that it also takes into account the pressure drop across the flashback arrester. A differential pressure may also be sensed, e.g., the pressure difference between a first point upstream of the sieve and a second point downstream of the flashback arrester. When the downstream pressure reaches a predetermined minimum or the pressure differential between the first and second points reaches a predetermined maximum, a signal (preferably a visual signal) is provided which prompts the furnace operator to take corrective action.

According to the invention, corrective action is taken by first operating the fuel shutoff valve to stop the flow of fuel to the burner assembly. When the burner flame is extinguished, the quick release mechanism on the sieve holder is operated to disengage the confronting flanges from the annular faces of the sieve holder. Because the corrugated expansion joint was under tension, it will retract or return to its unstressed condition spaced from the sieve holder and thereby provide a sufficient space between the gasketed annular end faces of the sieve holder and the confronting flanges so that the sieve holder may be readily removed transversely from between the confronting flanges. The occluded filter screen may then be removed and replaced by a new or cleaned screen and the sieve holder may be immediately reinserted between the confronting flanges. The quick release mechanism is operated to again seal the sieve holder between the confronting flanges. The fuel shutoff valve is then opened and when fuel flow is reestablished to the burner assembly, the burner will be relighted by the flame of the other furnace burners or by the installed burner ignition means.

It will be appreciated by those skilled in the art that the present invention provides a simple, yet effective solution to the problem of unnecessarily contaminating or clogging the absorber unit of a flame or flashback arrester. While it will still be necessary to periodically clean the flashback arrester of particulate matter small enough to pass through the filter screen of the sieve, such cleaning as will be required is not as difficult and time consuming as it would otherwise be if the present invention were not in use.

With the foregoing and other advantages and features of the invention that will become hereinafter apparent, the nature of the invention may be more clearly understood by reference to the following detailed description of the invention, the appended claims and the view illustrated in the drawing.

BRIEF DESCRIPTION OF THE DRAWING

The sole drawing FIGURE is a side elevational view, partly in cross-section and partly schematic, illustrating a preferred embodiment of the present invention.

DETAILED DESCRIPTION OF THE INVENTION

Referring now to the drawing, there is illustrated a portion of the combustion piping system of the invention which is designated generally by reference numeral 10. Flow through the piping system 10 is in the direction of the arrow A. The piping system portion 10 can be advantageously employed in the combustion piping system disclosed in the aforementioned U.S. Pat. No. 4,301,997.

Piping system portion 10 comprises a premixed fuel supply pipe 12 which connects with a shutoff valve 14 manually operable by means of an operator handle 16. The shutoff valve 14 could also be operable by automatic and/or power means as well. Shutoff valve 14 is connected to a conventional flexible expansion joint or coupling 18 fabricated, for example, from circumferentially corrugated metal tubing. The downstream end of the expansion joint 18 is provided with a flange 20 which is in sealing relation with the upstream end of a sieve means 22. The other end of the sieve means 22 is in sealing relation with the upstream flange 24 of a conventional flashback arrester 26 which is, in turn, connected to a pipe 28 connected to the burner assembly for supplying the premixed gaseous fuel to the burner. A pressure gauge 30 is connected to pipe 28 by a line 32 for measuring the fuel pressure in pipe 28. A pressure sensor or gauge 31 may also be connected to the fuel supply pipe 12 via a line 33 for measuring the fuel pressure upstream of the piping portion 10.

Referring now to the cross-sectional illustration of the sieve means 22, the same comprises a sieve holder 34 constructed as a tubular housing, preferably cylindrical, which houses or holds a filtering screen 36, such as a metal mesh screen. In the preferred embodiment, the screen 36 has a truncated conical shape with an annular rim 38 which may be seated in a shallow annular recess 40 in the upstream annular end face of the sieve holder 34. Both annular end faces of the sieve holder 34 are provided with sealing means, such as gaskets 42, 44, for sealing against the confronting surfaces of the respective flanges 20, 24. The gaskets 42, 44 are preferably affixed to the annular end faces of the sieve holder 34 by suitable means, such as cement, rivets or other equivalent means, but the gaskets 42, 44 may be affixed to the flanges 20, 24 as well. Other seals, such as O-rings or metal-to-metal face seals may also be utilized. The seals between the expansion joint flange 20 and the flashback arrester flange 24 and the respective annular end faces of the sieve holder 34 are effected by a quick release means or mechanism 48 comprising, in the preferred embodiment, a plurality (three or more) of threaded toggle bolts 50. Toggle bolts 50 are pivotally connected by pins 52 in radial slots or recesses 54 in flange 24 for pivotable movement in planes passing longitudinally through the longitudinal axis of the piping portion 10. Toggle bolts 50 engage in radial slots or recesses 56 in flange 20 and are provided on the threaded ends thereof with threaded nuts or dogs 58.

In the unstressed condition of the expansion joint 18, the confronting flanges 20 and 24 are spaced apart a distance greater than the total axial length of the sieve holder 34 and gaskets 42, 44. This condition is shown by the phantom lines 20' which represent the position of the flange 20 in the unstressed condition of the joint 18. The sieve holder 34 is provided with a handle means 46 affixed as by welding to the outer circumferential surface of the sieve holder 34 for a purpose to be hereafter described.

When tightened down to the position shown in the drawing, the toggle bolts 50 draw together the flanges 20, 24 thereby elongating slightly the expansion joint 18 and effecting a seal between the flanges and the gasketed end faces of the sieve holder 34.

In the condition shown in the drawing, the piping portion 10 is in its operable condition such that the premixed gaseous fuel flows through the piping 10 from the supply pipe 12 to the inlet pipe 28 of the burner assembly. In operation, the pressure gauge 30 will indicate a pressure within a preferred operating pressure range. When the pressure indicated by gauge 30 fall below a predetermined minimum fuel inlet pressure, (assuming normal operating pressures in the combustion piping system upstream of piping portion 10), such pressure drop indicates that the screen 36 is partly occluded with particulate matter carried in the premixed fuel flow. When such predetermined pressure drop occurs, the screen 36 in the sieve holder 34 must be replaced according to the following procedure.

First, the shutoff valve 14 is closed by means of the manual operation handle 16 to interrupt fuel flow to the furnace burner. When the burner flame is extinguished, the dogs 58 are unthreaded to a position which will permit them to be pivoted outwardly about pins 52 thereby releasing the connections between the flanges 20, 24. The expansion joint 18 will return to its unstressed condition with the flange 20 positioned as at 20' thereby permitting easy withdrawal of the sieve holder 34 transversely of the piping portion 10 by means of the handle 46. The screen 36 may then be readily removed and replaced by a new or cleaned screen. Using the handle 46, the sieve holder 34 is then returned to its position between the flanges 20, 24 and the toggle bolts 50 are pivoted into position in the slots 56 in flange 20. The dogs 58 are then tightened to effect a gasketed seal between the flanges 20, 24 and the annular end faces of the sieve holder 34 as shown in the drawing FIGURE. Thereafter, the shutoff valve 14 is opened by means of the operator handle 16 so that the premixed gaseous fuel again flows through the piping portion 10 to the burner assembly where it is ignited to produce the burner flame.

Advantageously, the sieve means 22 protects the flashback arrester 26 from becoming occluded by particulate matter which is difficult and time consuming to clean from the flashback arrester. Typically, flashback arresters are cleaned during routine furnace shutdown periods and the use of the present invention makes it possible to more easily clean the flashback arrester during shutdown periods. The invention also makes it possible to operate the furnace with a reduced gaseous fuel pressure at the fuel source since one important cause of the pressure drop through the piping system, namely, particulate matter that would otherwise occlude the flashback arrester can be quickly and easily removed from the piping system on a regular and more frequent basis than is practicable for flashback arrester cleaning and maintenance.

The pressure differential between the supply pipe 12 and inlet pipe 28 can also be determined by the different pressure between the two pressure sensors or gauges 30, 31. If desired, the pressure differential may be measured directly and a visual and/or audible indicator may be actuated when the pressure differential or pressure drop between lines 32 and 33 reaches a predetermined maximum.

It is also within the contemplation of the present invention that the expansion joint 18 be located between the sieve means 22 and the flashback arrester or in another appropriate position in the piping system which will still permit the axial space provided for the sieve means to increase when the quick release mechanism is operated to release the sieve means.

While the form of the screen 36 has been illustrated as a truncated cone, other shapes and forms are equally suitable and such shapes that provide a greater filtering area may be used, e.g., a corrugated cylindrical filter or the like. In addition, the relative axial length of the sieve holder 34 may be greater than as shown in the FIGURE. Similarly, other forms of quick release mechanisms may be used.

Although a certain presently preferred embodiment of the invention has been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A piping portion of a stationary combustion piping system of a metal melting furnace for supplying a flow of premixed gaseous fuel to a burner assembly, said piping portion comprising a flashback arrester, a shutoff valve located upstream of the flashback arrester, a sieve means disposed in said piping portion between the flashback arrester and the shutoff valve for collecting particulate matter from the flow of premixed gaseous fuel supplied to said burner assembly and means for connecting said sieve means in said piping portion and for permitting rapid withdrawal of the sieve means transversely of the piping portion for replacement or cleaning.

2. The piping portion of claim 1, including an expansion joint disposed in said piping portion.

3. The piping portion of claim 2, wherein said expansion joint is disposed between the sieve means and one of said shutoff valve and said flashback arrester.

4. The piping portion of claim 1, wherein said sieve means comprises a tubular housing, a filtering means removably mounted in said tubular housing, said tubular housing being transversely removable from the piping portion.

5. The piping portion of claim 4, wherein said tubular housing has opposite end faces, and gasket means affixed to said end faces for sealing said sieve means in said piping portion.

6. The piping portion of claim 5, including a handle means affixed to said tubular housing for removing the sieve means from the piping portion.

7. The piping portion of claim 1, wherein said connecting means for the sieve means comprises a pair of confronting flanges and a quick release means for sealingly clamping the sieve means between said flanges.

8. The piping portion of claim 7, wherein said quick release mechanism comprises a plurality of threaded toggle bolts pivotally connected to one of said flanges, a plurality of slots in the other flange for receiving said bolts and means on said toggle bolt for drawing said flanges into sealing engagement with the sieve means.

9. The piping portion of claim 8, wherein said drawing means comprises a threaded nut or dog.

10. The piping portion of claim 4, wherein said filtering means comprises a wire mesh screen having a truncated conical shape.

11. The piping portion of claim 1, including means for detecting the pressure drop across said sieve means.

12. The piping portion of claim 11, wherein said detecting means comprises a pressure gauge located between said piping portion and the burner assembly.

13. The piping portion of claim 11, wherein said detecting means comprises means for sensing the pressure differential across said sieve means.

14. The piping portion of claim 11, wherein said detecting means detects the pressure drop across said sieve means and said flashback arrester.

15. In a stationary combustion piping system for a metal melting furnace for supplying a premixed fuel to a burner assembly of the furnace, said piping system having a flashback arrester and a shutoff valve upstream of the flashback arrester, the improvement comprising a sieve means disposed in said piping system between said shutoff valve and said flashback arrester, said sieve means comprising a tubular housing and a filtering screen in said housing, and quick release means connecting said sieve means in said piping system for rapidly disconnecting and removing said sieve means independently of said flashback arrester without dismantling other portions of the stationary combustion piping system.

16. The improvement of claim 15, including an expansion joint disposed between the sieve means and one of said shutoff valve and said flashback arrester.

17. The improvement of claim 15, including a handle means affixed to said tubular housing for removing the sieve means from the piping system.

18. The improvement of claim 15, wherein said quick release means comprises a pair of confronting flanges for connecting the tubular housing of the sieve means in the piping system, a plurality of threaded toggle bolts pivotally connected to one of said flanges, a plurality of slots in the other flange for receiving said bolts and means on said toggle bolt for drawing said flanges into sealing engagement with said tubular housing.

19. The improvement of claim 15, wherein said filtering means comprises a wire mesh screen having a truncated conical shape.

20. The improvement of claim 15, including means for detecting a pressure drop across said sieve means.

* * * * *